US005205401A

United States Patent [19]

Weisburn et al.

[11] Patent Number: 5,205,401

[45] Date of Patent: Apr. 27, 1993

[54] CASSETTE SECURITY CONTAINER

[75] Inventors: James T. Weisburn, Massillon; John P. Hoerger, Minerva, both of Ohio

[73] Assignee: Alpha Enterprises, Inc., East Canton, Ohio

[21] Appl. No.: 721,113

[22] Filed: Jun. 26, 1991

[51] Int. Cl.[5] ..... A45C 13/10; B65D 85/672

[52] U.S. Cl. ..... 206/1.5; 206/387; 206/444; 206/807; 220/334; 220/4.22

[58] Field of Search ..... 206/1.5, 45.15, 45.23, 206/309, 312, 387, 444, 807, 815; 220/4.22, 4.23, 334

[56] References Cited

U.S. PATENT DOCUMENTS

| | | | |
|---|---|---|---|
| 3,871,516 | 3/1975 | Holkestad | 206/45.31 |
| 4,084,690 | 4/1978 | Pulse | 206/310 |
| 4,105,112 | 8/1978 | Graf | 206/1.5 |
| 4,119,200 | 10/1978 | Cassidy et al. | 206/815 |
| 4,285,429 | 8/1981 | MacTavish | 206/387 |
| 4,366,915 | 1/1983 | Seidler | 220/339 |
| 4,381,836 | 5/1983 | Rivkin et al. | 206/387 |
| 4,445,622 | 5/1984 | Sideri | 220/306 |
| 4,558,782 | 12/1985 | Iverson et al. | 206/387 |
| 4,589,549 | 5/1986 | Hehn | 206/387 |
| 4,627,534 | 12/1986 | Komiyama et al. | 206/387 |
| 4,634,001 | 1/1987 | Wakelin | 206/45.23 |
| 4,634,004 | 1/1987 | Mortensen | 206/387 |
| 4,648,307 | 3/1987 | Komiyama et al. | 206/387 |
| 4,702,369 | 10/1987 | Philosophe | 206/312 |
| 4,708,239 | 11/1987 | Bourbon | 206/387 |
| 4,718,547 | 1/1988 | MacTavish | 206/309 |
| 4,746,013 | 5/1988 | Suzuki et al. | 206/309 |
| 4,759,442 | 7/1988 | Gregersonetal | 206/387 |
| 4,781,292 | 11/1988 | Sacherman | 206/309 |
| 4,805,769 | 2/1989 | Soltis et al. | 206/309 |
| 4,834,238 | 5/1989 | Hehn et al. | 206/387 |
| 4,871,065 | 10/1989 | Hehn et al. | 206/387 |
| 4,881,645 | 11/1989 | Smiler et al. | 206/387 |
| 4,903,829 | 2/1990 | Clemens | 206/310 |
| 4,930,628 | 6/1990 | Bridges | 206/45.23 |
| 4,986,415 | 1/1991 | Posso | 206/45.23 |
| 5,022,516 | 6/1991 | Urban et al. | 206/45.15 |

FOREIGN PATENT DOCUMENTS

| | | | |
|---|---|---|---|
| 2187168 | 9/1987 | United Kingdom | 206/387 |

*Primary Examiner*—David T. Fidel
*Attorney, Agent, or Firm*—Michael Sand Co.

[57] ABSTRACT

A security container for holding and displaying an article such as a package containing a compact disc, audiocassette or videocassette, comprised of a base and a pivotally mounted lid. The base has an external size and shape generally equal to that of the article to be secured within an interior compartment formed by the base. The lid is pivotally mounted on the base by a pair of posts located on side walls of the base which are spaced from one of the end walls a sufficient distance to provide an end of the container having a thickness equal to the thickness of the article contained therein. This thickness of the end of the container enables the container to be placed within a display rack heretofore useable only for an unsecured package. A recess is formed in an inside surface of the lid for receiving and protecting a security detection device within the container. A lock is formed on the inside of the base by a plurality of flexible fingers which are formed on the lid and which are engageable with angled projections formed on the base. Key openings are formed in the base in alignment with the angled locking projections whereby a key can be inserted through the openings to remove the flexible fingers from the projections to unlock the lid to remove a cassette from the storage container.

18 Claims, 5 Drawing Sheets

FIG-9
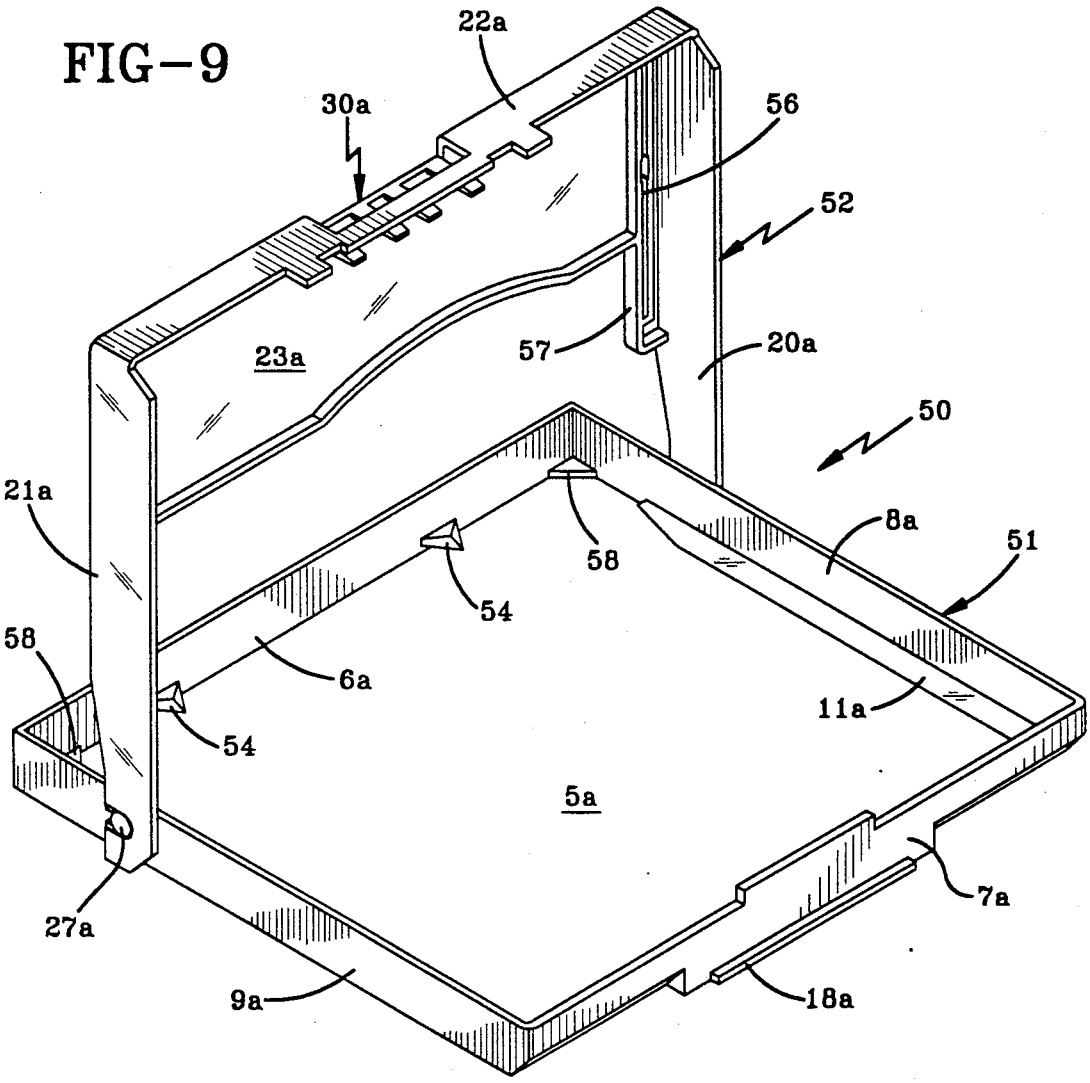
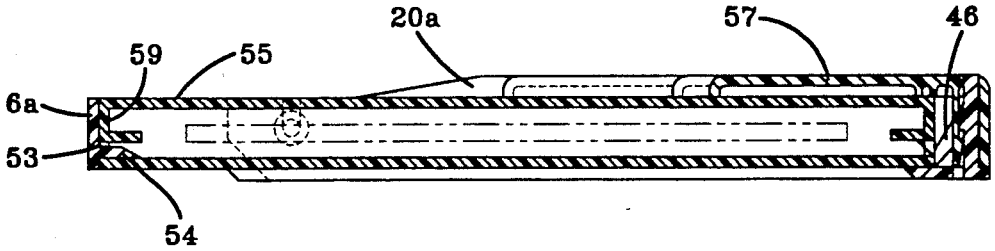
FIG-13

CASSETTE SECURITY CONTAINER

BACKGROUND OF THE INVENTION

1. Technical Field

The invention relates to a cassette security container of the type for holding a package containing an audio, video or CD cassette. More particularly the invention relates to such a security container which enables the cassette to be displayed in a usual display case or rack of the type heretofore used only for unsecured cassette display packages.

2. Background Information

Audiocassettes, videocassettes and compact discs (CD) have become increasingly popular over the past several years and have become an important segment of the recording and movie industry. These three general types of recording media are displayed in retail stores for sale and/or rental in a variety of display packages. Audiocassettes are most predominantly sold and displayed in a two-piece plastic case of the type shown as prior art in U.S. Pat. No. 4,627,534. These plastic display boxes are usually wrapped in a clear cellophane outer wrapping to protect the cassettes from contaminants and prevent their removal from the outer protective plastic package or box.

The video tapes or cassettes are usually displayed in a cardboard sleeve containing printed indicia thereon, which identifies a particular movie or other video program recorded on the cassette tape. These videocassettes also are then contained in a variety of display packages for subsequent display at the point of sale.

Likewise, CDs are most commonly stored in a container referred to as a "jewel box", somewhat similar to the type of package shown in U.S. Pat. Nos. 4,084,690, 4,702,369 and 4,903,829 wherein the disc is contained within a hinged-lid plastic package.

It has become important, especially in the audiocassette market, that the plastic packages or boxes in which the tapes are contained, be repackaged in an outer security package to prevent their theft from the display cases used in most retail businesses. Various types of display and security containers have been developed for audiocassettes such as shown in U.S. Pat. Nos. 4,759,442, 4,381,836, 3,871,516, 4,881,645, 4,834,238, 4,285,429 and 4,589,549. Likewise, due to the increased cost of CDs, security devices also have been developed for displaying them, such as shown in U.S. Pat. Nos. 4,718,547, 4,805,769 and 4,871,065.

Although these security containers for the various types of cassettes have proven satisfactory for many applications, they do present one major problem, that is the overall size of the security container is larger than desired for certain applications, and in particular for use with certain display cases. Various display cases have been developed for displaying audiocassettes, CDs and videocassettes, wherein these cassettes are displayed in their unsecured packages, usually by inserting the package at one end in an elongated groove or slot enabling the user to look at a plurality of such cassettes by pivotally moving the cassettes within their particular storage groove, which grooves are arranged in rows in the storage containers. One example of such a display rack is shown in U.S. Pat. No. 4,781,292, with another type being shown in FIG. 14 of the drawings of the present application.

These display cases can involve a substantial outlay of money by the store owner and are not applicable for use with the various cassettes when the cassettes are housed in security containers, due to the increased thickness, particularly in the ends of the security containers. This necessitates either displaying the cassettes in an unsecured package in the existing display racks, which can be expensive to the retail establishment due to loss through shoplifting and theft, or replace these existing display racks with new racks which can display the various cassettes in their security containers. Again, increasing operating costs for the merchant.

U.S. Pat. No. 4,627,534 is one of the closest prior art containers known relating to the subject invention, in that it recognizes this display problem due to the increased thickness of the display case, and attempts to solve the problem by providing a different type of cassette package. However, the package of this patent is still unsecured. Furthermore, it still increases the thickness of the bottom edge of the storage package making it unsuitable for display in various types of display racks heretofore used for the cassette packages not contained within a security container.

Therefore, the need exists for an improved security container for various types of cassettes, in which the cassettes are preferably maintained in their usual display packages, but when placed in the security container, are able to be displayed in display racks heretofore used for the unsecured package, by providing of an end portion of the security container with a thickness generally equal to the thickness of the usual unsecured display package now contained in the security container.

SUMMARY OF THE INVENTION

Objectives of the invention include providing an improved cassette security container wherein the cassettes are of the audio, video and CD recording mediums, which container enables the cassette to remain in its usual display and storage package, which in turn is secured within a container that retards theft of the cassette and its display package.

A further objective of the invention is to provide such an improved security container which has an end portion thereof with a thickness generally equal to the thickness of the display package containing the cassette, which display package is secured within the container, thereby enabling the security container to be mounted and displayed in display cases and racks heretofore only useable for the unsecured package, by positioning the security container in the display rack by the end of the container which has the same general shape and thickness of the cassette package contained therein.

Another objective of the invention is to provide such an improved security container which is provided with locking means whereby a closure lid of the container is secured in a locked position; in which the lid can be easily opened by use of a specially designed release key, thereby preventing or reducing the unauthorized removal of the cassette from within the security container; and which the locking lid enables the security container to be reused after the package and cassette is removed from the container by authorized personnel.

A further objective of the invention is to provide such an improved security container in which an electronic article surveillance device may be inconspicuously housed within the container to detect unauthorized removal of the container from a store without an authorized personnel first removing the packaged cassette from within the security container at a checkout counter.

Another objective of the invention is to provide such an improved security container which can be easily injection molded of various types of plastics in two components, namely a base and a lid, wherein the lid then is easily snap-fitted into position on the base, thus providing for the economic manufacture and assemble of the security container.

A further objective of the invention is to provide such a security container which may be provided with orienting tabs when used with CD display packages, for orienting the display package within the security container so that the identifying graphics is oriented in the proper position for easy reading by a customer perusing through a plurality of the displayed CDs within their security containers.

Still another objective of the invention is to provide such an improved security container for various types of cassettes, wherein the base of the container is generally equal in size and thickness to the cassette package to be contained therein, which has relatively open bottom and top containment walls which minimizes the amount of plastic material needed for injection molding of the base and lid; in which the lid also has a generally open top reducing the amount of plastic for its molding, thereby providing a finalized security container which uses a minimum amount of plastic material which reduces molding time and material costs, without sacrificing security.

A further objective of the invention is to provide such a cassette security container which is of a relatively simple construction, yet which achieves the stated objectives in a simple, effective and inexpensive manner, and which solves problems and satisfies needs in the art.

These and other objectives and advantages are obtained by the improved security container of the invention, which container holds an article, such as a package which contains a videocassette, audiocassette, compact disc or the like, the general nature of which may be stated as including a base having a storage compartment formed by first and second spaced parallel end walls, a pair of spaced parallel side walls and a bottom wall, and having an access opening opposite of the bottom wall for placing and removing an article into and from the storage compartment, said compartment having a size and configuration generally equal to that of the article being contained therein; the bottom wall terminating in a spaced relationship from the first end wall to provide an end portion of the container adjacent the first end wall having a thickness nearly equal to the thickness of the package contained within the storage compartment; a separate lid having a top wall, an end wall and a pair of spaced parallel side walls; pivot means spaced inwardly from the first wall of the base for pivotally mounting the lid on said base; locking means provided on the base and lid adjacent the second wall of the base for releasably securing said lid in a closed position on the base to prevent unauthorized removal o the article from the storage compartment; and key means engageable with the locking means for releasing the lid from the base enabling said lid to be moved to an open position for removal of the article from within the storage compartment.

BRIEF DESCRIPTION OF THE DRAWING

Preferred embodiments of the invention, illustrative of the best modes in which applicants have contemplated applying the principles, are set forth in the following description and are shown in the drawings and are particularly and distinctly pointed out and set forth in the appended claims.

FIG. 9 is a perspective view similar to FIG. 1, showing a modified form of the improved security container with the lid shown in partial open position, for holding and displaying a compact disc;

FIG. 13 is an enlarged longitudinal sectional view of FIG. 12, showing the security container in a closed position holding a CD therein;

Similar numerals refer to similar parts throughout the drawings.

DESCRIPTION OF THE PREFERRED EMBODIMENTS

Figure 1:
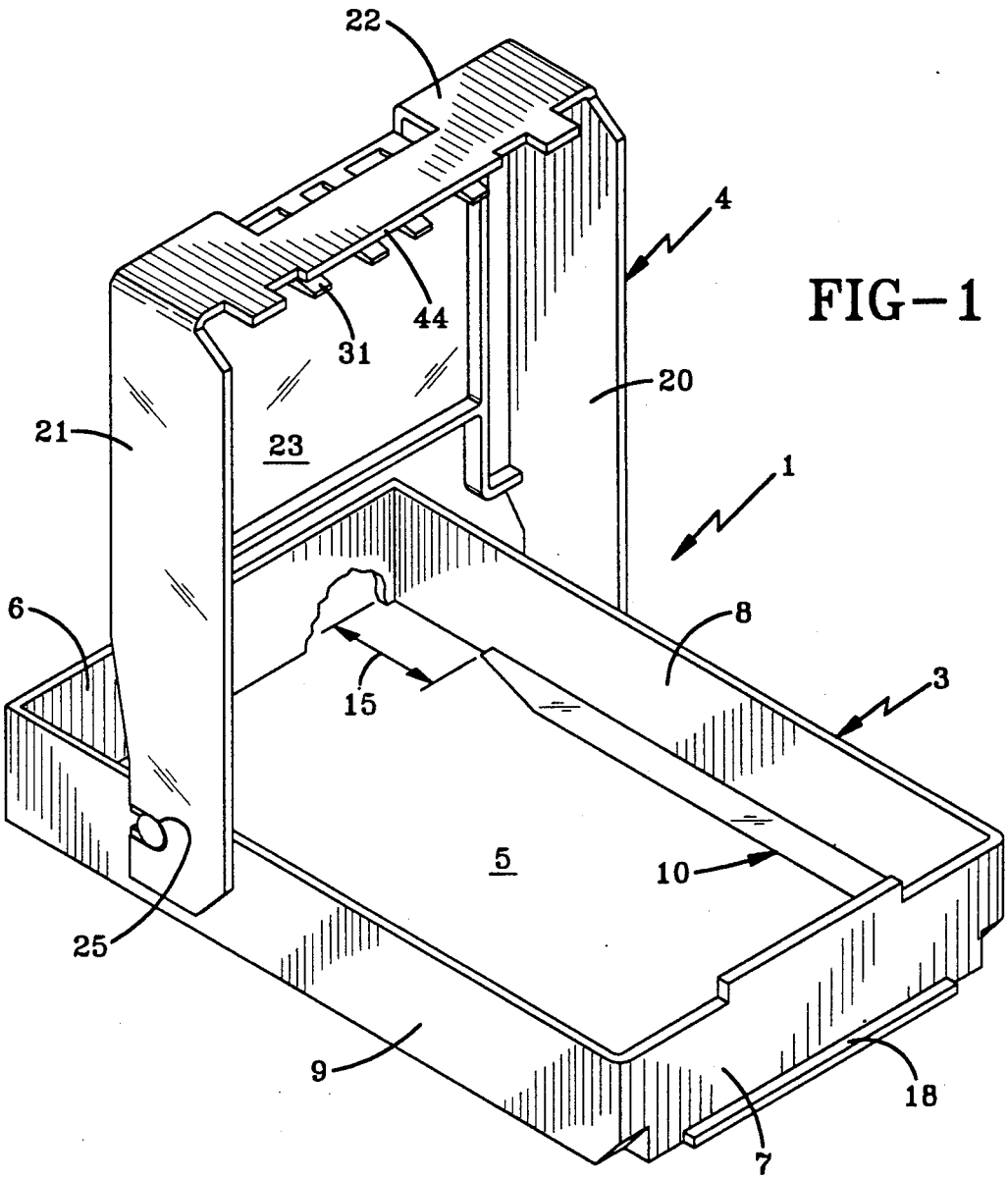
FIG. 1 is a perspective view of the improved security container of the type for holding an audiocassette or videocassette with the lid being shown in a partially open position.
Figure 5:
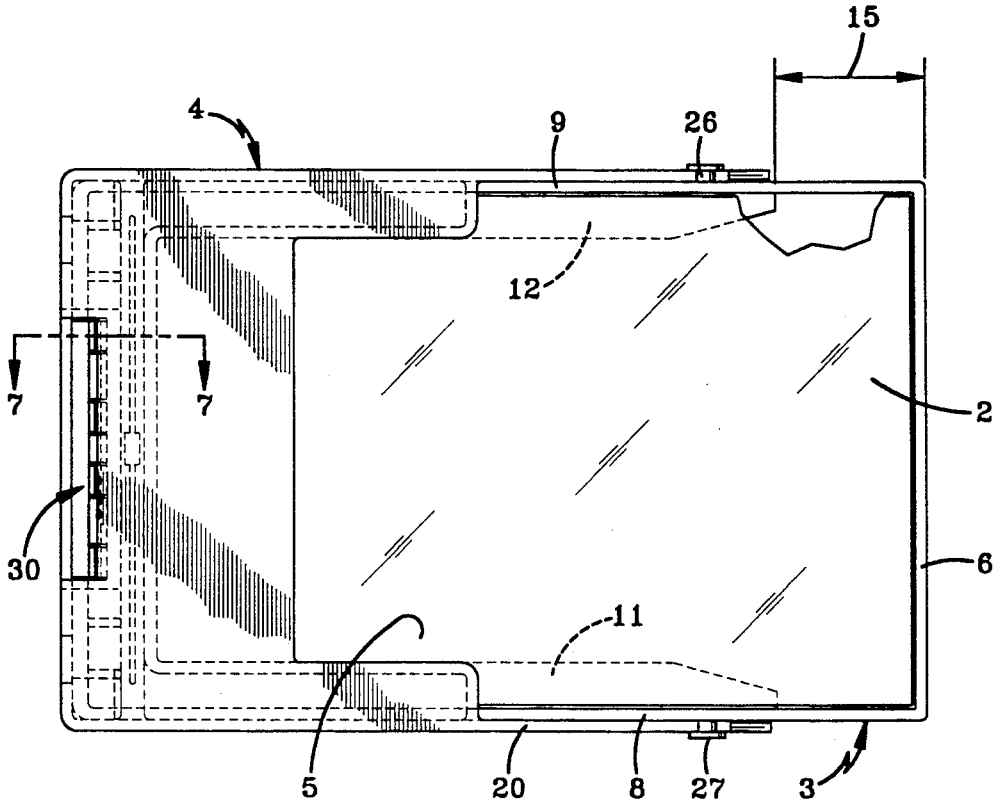
FIG. 5 is a top plan view of the security container of FIG. 1 with the lid shown in the closed locked position holding a cassette package therein.
Figure 6:
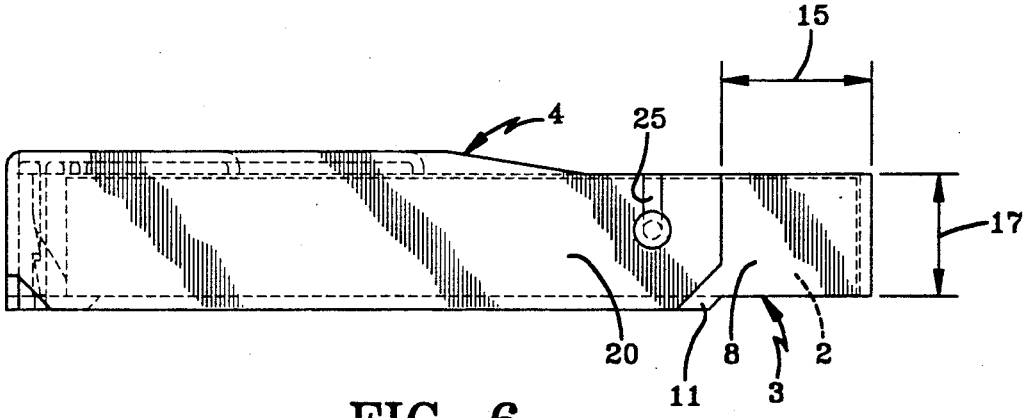
FIG. 6 is a side elevational view of the security container of FIG. 5.
Figure 10:
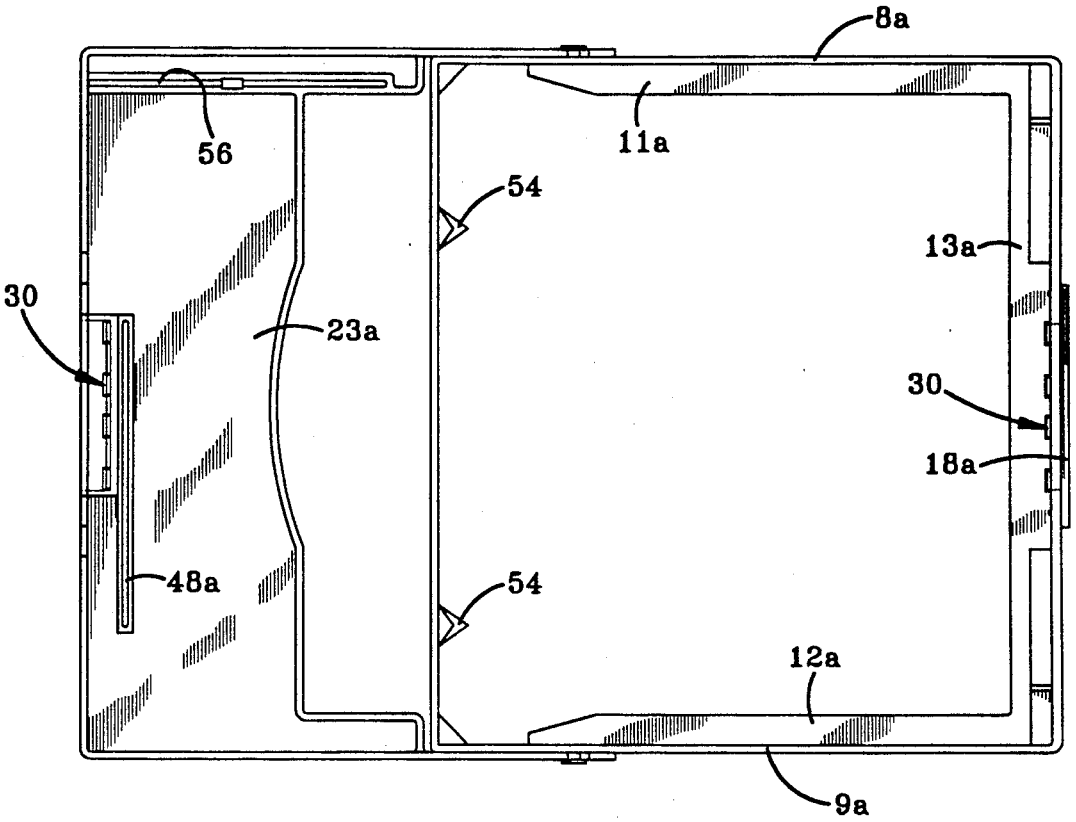
FIG. 10 is a top plan view of the security container of FIG. 9 with the lid shown in full open position.
Figure 11:
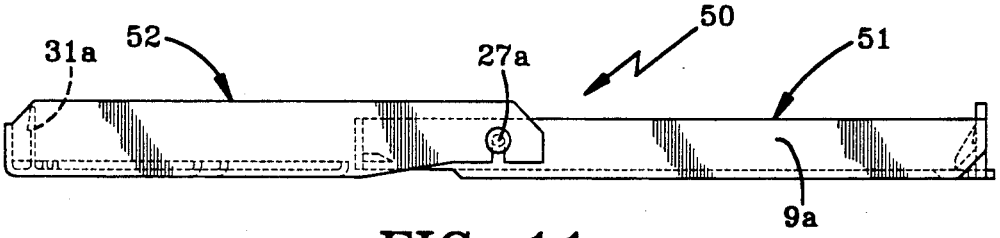
FIG. 11 is a side elevational view of the security container as shown in FIG. 10.
Figure 12:
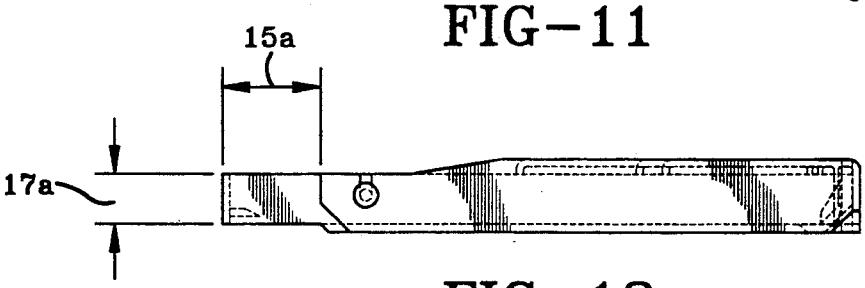
FIG. 12 is a side elevational view similar to FIG. 11, with the lid shown in a closed locked position.

A first embodiment of the improved security container is indicated generally at 1, and is shown particularly in FIG. 1. Container 1 is of the type which is used for audiocassettes and videocassettes, with the main difference being the overall dimensions thereof. When used for an audiocassette, it will contain the usual plastic package or case, indicated at 2 and shown particularly in FIGS. 5 and 6, which is used for the sale and storage of audiocassettes. When used with a usual videocassette, container 1 will house a usual cardboard graphics sleeve (not shown) of the type well known in the art.

Container 1 includes two main components, a base and lid, indicated generally at 3 and 4 respectively. Base 3 has a rectangular configuration and forms an internal storage compartment 5 formed by parallel spaced first and second end walls 6 and 7, a pair of spaced parallel sidewalls 8 and 9, and a bottom wall, indicated generally at 10.

Figure 2:
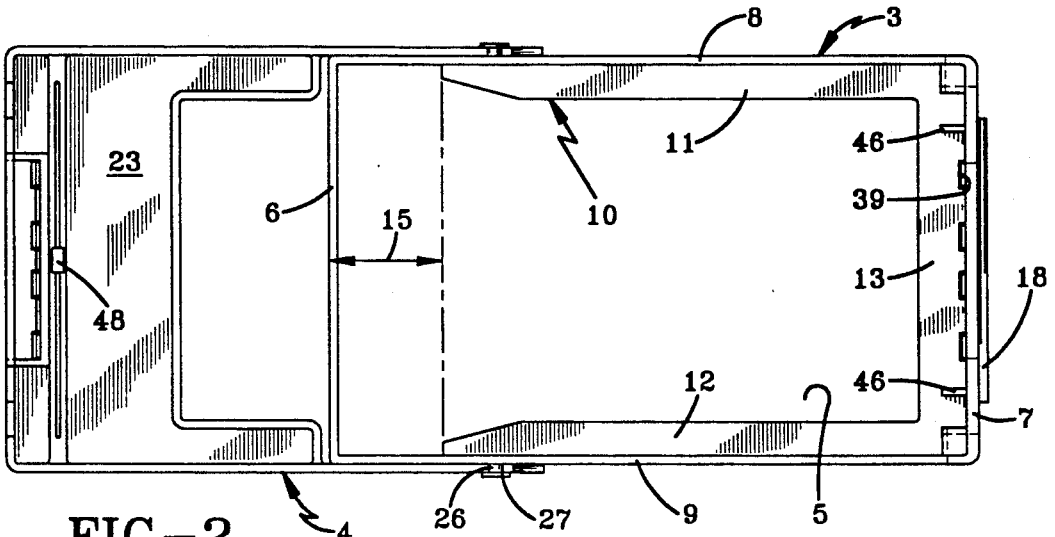
FIG. 2 is a top plan view of the security container of FIG. 1 with the lid being shown in a fully open position.

Bottom wall 10 as shown particularly in FIG. 2, has a generally U-shaped configuration formed by spaced parallel ledges 11 and 12 which extend along and are formed integrally with the bottom edges of sidewalls 8 and 9 respectively, and a third ledge 13 which is formed integrally with second end wall 7 and extends along the bottom edge thereof. Thus ledge 13 in combination with ledges 11 and 12, form U-shaped bottom wall 10.

Figure 3:
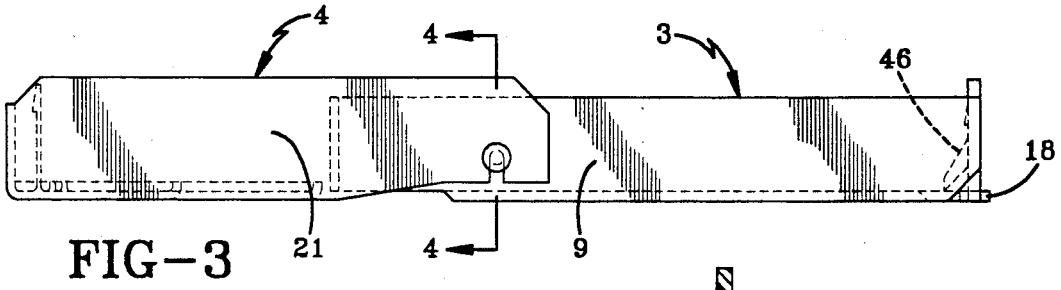
FIG. 3 is a side elevational view of the security container of FIG. 2.

In accordance with one of the features of the invention, bottom wall forming ledges 11 and 12 terminate a predetermined distance indicated at 15, from first end wall 6. This provides an end of container 1, best shown in FIGS. 5 and 6, which is free of any external projections and which has a thickness represented by arrow 17, equal to the end wall thickness of package 2 contained therein, due to the absence of any bottom wall or top wall throughout distance 15 of the end portion. A lid engaging stop 18 is formed integrally with and extends outwardly from the bottom edge of second end wall 7 (FIGS. 2 and 3).

Figure 4:
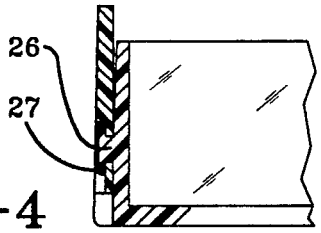
FIG. 4 is an enlarged fragmentary sectional view taken on line 4—4, FIG. 3.

In accordance with another feature of the invention, a pair of keyhole-shaped slots 25 are formed in the outer ends of sidewalls 20 and 21 of lid 4 which are snap-fitted over a pair of pivot posts 26 (FIG. 4) which are formed integrally with and extend perpendicularly outwardly from base sidewalls 8 and 9. Pivot posts 26 have outer disc-shaped ends 27 which trap lid walls 20 and 21 on the pivot posts. This arrangement enables base 3 and lid 4 to be separately molded and then lid 4 merely snap-fitted into position on base 3 by engagement of pivot posts 26 within key-shaped slots 25. This enables the two components which are of a relatively simple generally rectangular shaped design, to be easily molded in less complicated and less expensive dies than more complicated single piece type of containers having irregular shapes.

Figure 7:
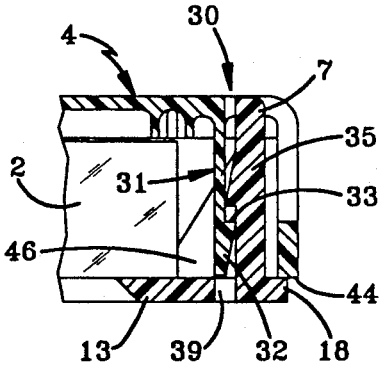
FIG. 7 is an enlarged fragmentary sectional view taken on line 7—7, FIG. 5 showing the locking mechanism for the security container.
Figure 8:
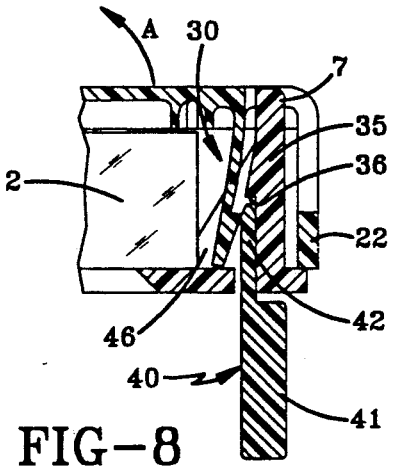
FIG. 8 is a fragmentary sectional view similar to FIG. 7 showing a manually operated key engageable with the locking mechanism of FIG. 7.

In further accordance with the invention, an improved locking means indicated generally at 30, is formed in combination on base end wall 7 and lid end wall 22, for releasably securing lid 4 in a closed locked position as shown particularly in FIGS. 5–8. Locking means 30 includes a plurality of flexible fingers 31, four of which are shown on container 1. However, this number can vary without affecting the concept of the invention. Fingers 31 (FIGS. 7 and 8) each include a tapered outer end 32 which forms a shoulder 33 with the remaining stem portion of the finger. Tapered outer ends 32 when moving to a locked position as shown in FIG. 7, will slide over an inwardly downwardly tapered projection 35 formed integrally with end wall 7, which also is provided with a right angled shoulder 36. When moving towards the closed position, tapered outer ends 32 of fingers 31 will slide along and pass tapered projections 35 of end wall 7, whereupon the flexibility of the fingers will enable them to snap-back into position, preventing lid 4 from moving to the open position by the abutting engagement of right angled shoulders 33 and 36 as shown in FIG. 7.

Figure 15:
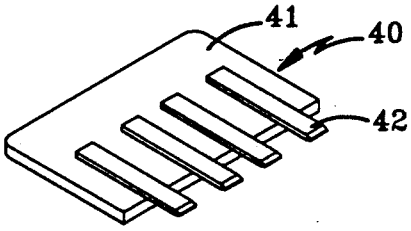
FIG. 15 is a perspective view of a key for unlocking the lid of the security container.

A plurality of key receiving openings or holes 39 are formed in bottom wall ledge 13 in alignment with fingers 31 (FIGS. 2 and 7). To disengage flexible fingers 31 from tapered projections 35 to unlock lid 4, a key 40 (FIG. 15) is utilized. Key 40 includes a manually grasp base 41 having a plurality of tangs 42 extending outwardly therefrom, which upon insertion through openings 39 will slide along tapered outer ends 32 of fingers 31 bending the fingers inwardly whereby upward movement of the lid in the direction of arrow A (FIG. 8), will enable the heretofore abutting shoulders 33 and 36 to move past each other enabling the lid to move to an open position. When in the locked position, end wall 22 of lid 4 will be in juxtaposition with and outside of base end wall 7 and a bottom edge 44 of lid end wall 22, will abut against lid stop 18 to properly place lid 4 in its locked position thereby preventing movement of lid 4 in either the opening or closing direction to maintain fingers 31 engaged with tapered end wall projections 35.

To prevent cassette package 2 from interfering with the movement of flexible fingers 31, a pair of tapered spacers 46 (FIGS. 2, 7 and 8) are formed integrally with end wall 7 of base 3 and extend in an angled relationship between the inside surface of end wall 7 and bottom wall ledge 13. These tapered spacers ensure that package 2 is firmly seated within storage compartment 5 of base 3 to reduce rattle of the package within the container, and ensures that the package is spaced sufficiently from end wall 7 to provide clearance for fingers 31 and to enable the fingers to flex upon closing of lid 4 and upon opening when engaged with key tangs 42.

In accordance with another feature of the invention, a recess 48 is formed on the inside surface of top wall 23 of lid 4 for receiving a security device, commonly referred to as an EAS (electronic article surveillance). This device usually will be formed of a magnetic detectable material and will activate an alarm if moved between detectors generally located at the entrance of the retail store. This EAS device may be secured within recess 48 by an adhesive or encapsulation, and is prevented from being tampered with due to its location within the container, when the container is in its secured locked position.

A second embodiment of the improved security container is indicated generally at 50, and is shown in FIGS. 9–13. Embodiment 50 is similar in most respects to embodiment 1 in that it includes as main components a base 51 and a lid 52 with the main difference therebetween being the size of the side and end walls thereof and the size of storage compartment 5*a* formed by base 51. Therefore, the individual construction of base 51 and lid 52 is not described in further detail with the parts similar to those of container 1 being identified by the suffix letter "a".

One of the features incorporated into base 51 of container 50 not present in base 3 of container 1, is a pair of orienting tabs 54 which are formed on end wall 6*a* and extend inwardly into storage compartment 5*a*. These tabs have tapered front edges and are spaced above the bottom edge of wall 6*a* and extend into openings 53 formed in the sidewall 59 of a usual CD storage and display package or "jewel box" 55 when the package is placed within storage compartment 5*a* (FIG. 13). Tabs 54 ensure that package 55 is oriented in the correct position within base 51 so that the graphics contained therein are properly oriented for viewing when displayed in a display rack.

One other difference in container 50 from that of container 1, is the location of an EAS recess 56 which is formed in an extension 57 of top lid wall 23*a* (FIG. 9), instead of the recess being formed directly in the top wall as shown in FIG. 2 for container 1. Also for certain applications, an extremely thin gusset 58 may be formed in the open end of base 51 between end wall 6*a* and sidewalls 8*a* and 9*a*, to provide increased rigidity for base 51 due to its larger size than base 3 of container 1. Locking means 30 are basically the same for container 50 as that of container 1, and thus is not described in further detail.

Figure 14:
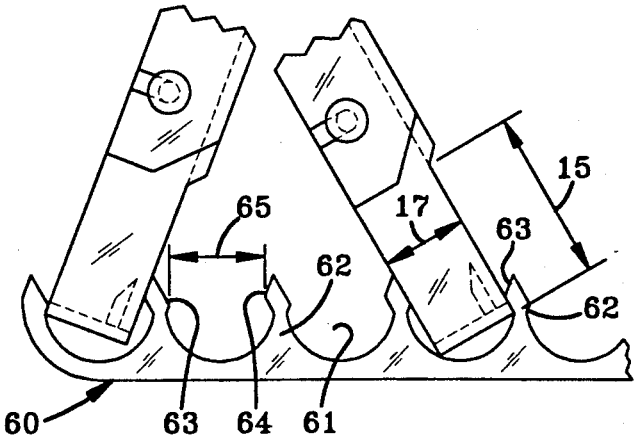
FIG. 14 is a fragmentary diagrammatic side elevational view showing the security container being displayed in a usual display rack.

Again, the important feature of container 50 is that the thickness 17*a* of the container end portion, which is indicated at 15*a*, is the same as the thickness of CD storage package 55, which enables container 50 to be used within a display rack, as shown in FIG. 14 and described below. One of the main advantages of the improved security container is illustrated in FIG. 14, in which the container is mounted and displayed in a display case or rack indicated generally at 60. Rack 60 is of a type consisting of a plurality of elongated spaces or grooves 61 formed by a series of projections 62. Projection 62 usually will have spaced wall portions 63 and 64 separated by a distance 65. These racks enable a customer to look at a plurality of cassettes by pivoting them between forward and back positions as shown by dash lines in FIG. 14. These racks are designed so that groove 62 has a width 65 which is equal to or slightly greater than the width of the plastic storage package 2 of an audiocassette or graphics display sleeve of a videocassette, or storage package for a CD. This Distance 65 is generally the same as the thickness of end wall 6 and sidewalls 8 and 9 of container 1, and for the same end and sidewalls of container 50. Thus, containers 1 and 50 can be mounted within display rack grooves 61, due to the thickness of the end of the security container being the same as either the audio or video package or the CD package securely contained therein, which extends throughout a length sufficiently great to extend beyond the top of display projections 62, which are distances 15 and 15*a* of containers 1 and 50, respectively.

Preferably distances 15 and 15*a* will be approximately one inch, and preferably will be within the range of between 20% and 30% of the length of sidewalls 8–9 and 8*a*–9*a* of containers 1 and 50.

Another advantage of the improved security container is that bases 3 and 51 have completely open tops, and bottom walls formed only by the U-shaped configuration of the three ledges. This provides for the easy insertion and removal of a cassette into and out of the base through the completely open top, as well as providing a sufficiently open bottom for viewing of the graphics on the display package within the container. Furthermore, such a construction requires considerably less plastic than other security containers having more full bottom wall and top wall closures. Another advantage is the compact size of the container when in the closed position due to lid sidewalls 20 and 21 lying in closed juxtaposition with base sidewalls 8 and 9, respectively, when in the closed position.

Accordingly, the cassette security package is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved cassette security package is constructed and used, the characteristics of the construction, and the advantageous, new and useful results obtained; the new and useful structures, devices, elements, arrangements, parts and combinations, are set forth in the appended claims.

We claim:

1. A security container for an article including:

a base having a storage compartment formed by first and second spaced parallel end walls, a pair of spaced parallel side walls and a bottom wall, and having an access opening opposite of the bottom wall for placing and removing an article into and from the storage compartment, said compartment having a size and configuration generally equal to that of the article being contained therewith the bottom wall terminating in a spaced relationship from the first end wall to provide an end portion of the container having a thickness nearly equal to the thickness of the package contained within the storage compartment;

a separate lid having a top wall, an end wall and a pair of spaced parallel side walls;

pivot means spaced inwardly from the first wall of the base for pivotally mounting the lid on said base;

locking means provided on the base and lid for releasably securing said lid in a closed position on the base to prevent unauthorized removal of the article from the storage compartment; and key means engageable with the locking means for releasing the lid from the base enabling said lid to be moved to an open position for removal of the article from within the storage compartment.

2. The security container defined in claim 1 in which the pivot means is a pair of pivots located on the sidewalls of the base located at least an inch inwardly from the first end wall.

3. The security container defined in claim 2 in which the pair of pivots is located a distance between 20% and 30% of the side wall length from said first end wall.

4. The security container defined in claim 1 in which the pivot means includes a pair of pivot posts extending generally perpendicularly outwardly from the side walls of the base and a generally key-shaped opening formed in each of the side walls of the lid; and in which the pivot posts are snap-fitted into engagement within the key-shaped openings of the lid sidewalls.

5. The security container defined in claim 1 in which the bottom wall of the base is substantially open and is comprised of a first ledge adjacent to and extending along the second end wall of the base, and a pair of spaced second and third ledges, each being adjacent to and extending along a respective one of the spaced sidewalls of said base.

6. The security container defined in claim 5 in which the first, second and third ledges form a generally U-shaped bottom wall of the base.

7. The security container defined in claim 1 in which a substantial portion of the top wall of the lid is open; and in which a recess is formed on an inner surface of the lid for holding a security detection device therein which is unaccessible when the lid is in the closed position.

8. The security container defined in claim 1 in which the locking means includes at least one flexible finger having a locking end portion mounted on either the lid or the base, and an angled engaging projection mounted on the other of said lid or base.

9. The security container defined in claim 8 in which opening means is formed in either the lid or base adjacent the locking means for insertion of the key means therethrough for moving the flexible finger out of engagement with the angled engaging projection whereby the lid can be moved to an open position.

10. The security container defined in claim 9 in which the flexible finger is formed on the lid and the angled engaging projection is formed on the base; and in which the key means opening means is formed in the base.

11. The security container defined in claim 10 in which at least two flexible fingers are formed on an inner surface of the lid and extend generally parallel with and spaced from the end wall of said lid; and in which at least two engaging projections are formed on an inner surface of the second end wall of the base and are spaced from the bottom wall of said base.

12. The security container defined in claim 11 in which the key means opening means includes at least a pair of openings formed in the bottom wall of the base, each of said openings being aligned with a respective one of the engaging projections.

13. The security container defined in claim 9 in which spacer means is formed on the second end wall of the base for locating an article in the storage compartment and for providing a locking space between said second end wall and the article for receiving the flexible finger and angled engaging projection therein.

14. The security container defined in claim 13 in which the spacer means includes a pair of spaced tapered projections having inwardly sloped surfaces for guiding an article into the storage compartment.

15. The security container defined in claim 1 in which the article is a package for holding a compact disc; in which a pair of spaced tabs are formed on the first end wall of the base and extend into the storage compartment; and in which said tabs are adapted to extend into side wall openings formed in the compact disc package for orienting the package within the storage compartment.

16. The security container defined in claim 15 in which the tabs have tapered front ends for insertion into the side wall openings of the compact disc package; and in which the tabs are spaced above a bottom edge of said first end wall.

17. The security container defined in claim 1 in which the end wall of the lid is in juxtaposition with and outside of the second end wall of the base when the lid is in the closed position.

18. A security container for an article including:

a base having a storage compartment formed by first and second spaced parallel end walls, a pair of spaced parallel side walls and a bottom wall, and having an access opening opposite of the bottom wall for placing and removing the package into and from the storage compartment, said compartment having a size and configuration generally equal to that of the article being contained therewith, said bottom wall terminating in a spaced relationship from the first end wall to provide an end portion of the container defined only by the first end wall and adjacent portions of the sidewalls and having a thickness defined by the height of said end wall and sidewall portions nearly equal to the thickness of the package contained within the storage compartment;

a separate lid having a top wall, an end wall and a pair of spaced parallel side walls; and pivot means spaced inwardly from the first wall of the base for pivotally mounting the lid on said base.

* * * * *